United States Patent [19]

Mifune et al.

[11] 4,276,374

[45] Jun. 30, 1981

[54] SILVER HALIDE PHOTOGRAPHIC EMULSION WITH THIOETHER SENSITIZER

[75] Inventors: Hiroyuki Mifune; Nobuaki Miyasaka; Yoshiharu Fuseya, all of Minami-ashigara, Japan

[73] Assignee: Fuji Photo Film Co., Ltd., Minami-ashigara, Japan

[21] Appl. No.: 43,962

[22] Filed: May 30, 1979

[30] Foreign Application Priority Data

May 30, 1978 [JP] Japan ..... 53-64577

[51] Int. Cl.[3] ..... G03C 1/34

[52] U.S. Cl. ..... 430/611; 430/489; 430/550; 430/551; 430/603; 430/629; 562/557; 562/594; 568/46

[58] Field of Search ..... 430/603, 611, 372, 630, 430/591, 505, 544, 551, 550, 629, 489; 260/609 R, 609 C

[56] References Cited

U.S. PATENT DOCUMENTS

| | | | |
|---|---|---|---|
| 2,955,036 | 10/1960 | Dersch et al. | 430/611 X |
| 3,021,215 | 2/1962 | Williams et al. | 430/550 |
| 3,057,724 | 10/1962 | Lovett et al. | 430/603 |
| 3,506,443 | 4/1970 | Motter | 430/377 |
| 3,625,697 | 12/1971 | Sato et al. | 430/551 X |
| 4,057,429 | 11/1977 | De Brabandere et al. | 430/569 |

OTHER PUBLICATIONS

Mees, Charles Edward Kenneth: The Theory of the Photographic Process, 1977, McMillan, U.S.A. pp. 149–154; 393–399.

*Primary Examiner*—Edward C. Kimlin
*Attorney, Agent, or Firm*—Sughrue, Rothwell, Mion, Zinn and Macpeak

[57] ABSTRACT

A silver halide photographic emulsion containing the compound represented by the formula (I):

$$R_1—(X—R_3)_m—X—R_2 \quad (I)$$

wherein $R_1$ and $R_2$ each represents an alkyl group containing 1 to 5 carbon atoms substituted with two or more substituents selected from —OH, —$NHR_4$, —$COOR_4$, —$CONH_2$, —$SO_3H$, —COOM, or —$SO_3M$, $R_3$ represents an alkylene group containing 1 to 4 carbon atoms which may be substituted by —OH, $R_4$ represents a hydrogen atom or an alkyl group containing 1 to 5 carbon atoms, X represents a sulfur or oxygen atom, provided at least one X is a sulfur atom, m represents 0 or an integer of 1 to 4, and M represents an alkali metal atom.

11 Claims, No Drawings

SILVER HALIDE PHOTOGRAPHIC EMULSION WITH THIOETHER SENSITIZER

BACKGROUND OF THE INVENTION

1. Field of the Invention

The present invention relates to a silver halide photographic emulsion and, more particularly, to a silver halide photographic emulsion containing an organic thioether compound.

2. Description of the Prior Art

In the production of silver halide photographic emulsions, it has long been known to use organic thioether compounds as solvents for silver halide or as chemically sensitizing agents.

For example, U.S. Pat. Nos. 3,271,157, 3,531,289, 3,574,628, 4,057,429, etc., describe the techniques of producing a so-called monodisperse emulsion containing silver halide grains of a uniform size, by allowing an organic thioether compound to coexist in the silver halide (AgX) formation step or upon physical ripening for producing silver halide photographic emulsions (hereinafter merely referred to as emulsion).

Also, U.S. Pat. Nos. 2,521,926, 3,021,215, 3,038,805, 3,506,443, 3,057,724, 3,062,646, 3,574,709, 3,622,329, 3,625,697, etc., describe the techniques for raising photographic sensitivity of the emulsion by allowing an organic thioether compound to exist upon chemical ripening for producing the emulsion or immediately before coating.

However, existence of an organic thioether compound upon preparation of the emulsion tends to increase fog.

Although it is known that addition of conventionally known thioether compounds serves to enhance photographic sensitivity, the degree of increase in photographic sensitivity in the case of exposing with a comparatively high illuminance for a short time (for example, 1/100 to 1/1,000 second) is about the same as that in the case of exposing with a low illuminance for a long time (for example, 5 to 10 seconds) and, as opposed to the present invention, the reciprocity law failure in low illuminance region has never been improved. (The term "reciprocity law failure" as used in the photographic science refers to the fact that photographic sensitivity changes with exposure time, and improvement in reciprocity law failure indicates that the change in photographic sensitivity with exposure time is reduced.)

In order to prevent the fog caused by the organic thioether compounds, it has been known, for example, to conduct Agx formation at a pH of not more than 4, or to super-purify the organic thioether compounds. However, these techniques have such defects that sufficient effects cannot be attained and they cannot be practically conducted on an industrial scale.

SUMMARY OF THE INVENTION

It is, therefore, an object of the present invention to provide an emulsion which does not suffer an increase of fog even when photographic sensitivity is raised using an organic thioether compound in preparing the emulsion.

Another object of the present invention is to provide an emulsion which shows a similarly high photographic sensitivity in both low illuminance exposure and high illuminance exposure, while suffering less fog.

A further object of the present invention is to provide a method for raising both low illuminance sensitivity and high illuminance sensitivity without increasing fog in producing a silver halide photographic emulsion.

Other objects of the present invention will become apparent from the following detailed descriptions.

DETAILED DESCRIPTION OF THE INVENTION

The above objects of the present invention have been attained with a silver halide photographic emulsion containing the thioether compound represented by the following formula (I):

$$R_1-(X-R_3)_m-X-R_2 \qquad (I)$$

wherein $R_1$ and $R_2$ each represents an alkyl group, and preferably a straight chain or branched chain alkyl group containing 1 to 5 carbon atoms substituted by —OH, $-NHR_4$, $-COOR_4$, $-CONH_2$, $-SO_3H$, —COOM, or $-SO_3M$, the number of the substituents being 2 or more, preferably 2 or 3 for each of $R_1$ and $R_2$, $R_3$ represents an alkylene group containing 1 to 4 carbon atoms which may be substituted by —OH, $R_4$ represents a hydrogen atom or a straight or branched chain alkyl group containing 1 to 5 carbon atoms (e.g., a methyl group, an ethyl group, etc.), X represents a sulfur atom or an oxygen atom, provided that at least one X in the molecule is a sulfur atom (thus, when m represents 0, X must represent a sulfur atom), m represents 0 or an integer of 1 to 4, preferably an integer of 1 to 4, and M represents a monovalent alkali metal atom (e.g., sodium, potassium, etc.). Particularly preferable compounds are those wherein m represents an integer of 1 to 4, and at least two sulfur atoms exist in one molecule.

Of the thioether compounds represented by the formula (I), the compounds represented by the following formula (II) are more preferred:

$$R_5-\underset{\underset{OH}{|}}{CH}-(CH_2)_{n1}-S-(CH_2)_{n2}-S-(CH_2)_{n3}-\underset{\underset{OH}{|}}{CH}-R_5 \qquad (II)$$

wherein $R_5$ represents an alkyl group, and preferably a straight chain alkyl group containing 1 to 3 carbon atoms substituted by —OH or —COOH, the number of the substituents being 1 or 2, $n_1$ and $n_3$ each represents 1 or 2, and $n_2$ represents 1, 2, 3, or 4.

Specific examples of the thioether compounds favorably used in the present invention are as follows. The present invention, however, is not limited to the use of these compounds.

$$HOOCCH_2\underset{\underset{OH}{|}}{CH}CH_2-SCH_2CH_2-S-CH_2\underset{\underset{OH}{|}}{CH}CH_2COOH \qquad (1)$$

$$HOOCCH_2\underset{\underset{COOH}{|}}{CH}SCH_2CH_2S\underset{\underset{COOH}{|}}{CH}CH_2COOH \qquad (2)$$

$$HOCH_2\underset{\underset{OH}{|}}{CH}CH_2SCH_2CH_2SCH_2\underset{\underset{OH}{|}}{CH}CH_2OH \qquad (3)$$

$$HOCH_2\underset{\underset{OH}{|}}{CH}CH_2SCH_2\underset{\underset{OH}{|}}{CH}CH_2SCH_2\underset{\underset{OH}{|}}{CH}CH_2OH \qquad (4)$$

$$HOOC\underset{\underset{NH_2}{|}}{CH}CH_2SCH_2CH_2SCH_2\underset{\underset{NH_2}{|}}{CH}COOH \qquad (5)$$

$$CH_3\underset{\underset{OH}{|}}{CH}-\underset{\underset{OH}{|}}{CH}CH_2SCH_2CH_2SCH_2\underset{\underset{OH}{|}}{CH}-\underset{\underset{OH}{|}}{CH}CH_3 \qquad (6)$$

-continued $$HOCH_2\underset{\underset{OH}{|}}{C}HCH_2OCH_2CH_2SCH_2CH_2SCH_2CH_2OCH_2\underset{\underset{OH}{|}}{C}HCH_2OH \quad (7)$$

$$HOCH_2\underset{\underset{OH}{|}}{C}HCH_2SCH_2CH_2OCH_2CH_2SCH_2\underset{\underset{OH}{|}}{C}HCH_2OH \quad (8)$$

$$HOOC\underset{\underset{NH_2}{|}}{C}HCH_2SCH_2CH_2CH_2CH_2SCH_2\underset{\underset{NH_2}{|}}{C}HCOOH \quad (9)$$

Processes for synthesizing the organic thioether compounds used in the present invention are not particularly limited, and quite common processes may be used. For example, they can be synthesized by reference to the descriptions in British Pat. No. 950,089, U.S. Pat. No. 3,021,215, *Journal of the Organic Chemistry,* 26, pp. 1991–1995 (1961), and the like.

For example, the thioether compounds of the present invention can be synthesized by reacting an alkylene dihalide with a sodium salt of unsubstituted or substituted alkyl mercaptan as illustrated below.

$$Cl\text{-}(CH_2)_n\text{-}Cl + 2\ NaS\text{-}R_1 \rightarrow R_1\text{-}S\text{-}(CH_2)_n\text{-}S\text{-}R_1$$

The thioether compounds of the present invention can also be synthesized by reacting sodium dithiolate with an unsubstituted or substituted alkyl halide as illustrated below.

$$NaS\text{-}(CH_2)_n\text{-}SNa + 2\ Cl\text{-}R \rightarrow R\text{-}S\text{-}(CH_2)_n\text{-}S\text{-}R$$

A typical synthesis example of the thioether compound according to the present invention is illustrated in the following Synthesis Example for Compound 3.

SYNTHESIS EXAMPLE

Preparation of Compound 3

To 220 g (2.04 mols) of 3-mercapto-1,2-propanediol were added 500 ml of methanol and 386 g of a 28% methanolic solution of sodium methylate (2.00 mols of sodium methylate). 99 g (1.00 mol) of 1,2-dichloroethane was added dropwise to the resulting solution at 45° C. with stirring. Some heat was generated by this addition. After the addition was over, the resulting mixture was stirred for 4 hours while adjusting the temperature thereof to 55° to 60° C. After completion of the reaction, the reaction mixture was cooled and adjusted to a pH of 5 to 7 with hydrochloric acid to precipitate NaCl, which was removed by filtration. The filtrate was concentrated under reduced pressure. To the residual oily product was added 400 ml of acetone and 200 ml of ethyl acetate and the mixture was stirred while cooling to precipitate crystals. Recrystallization of the crude crystals thus obtained from 2 l of acetone gave 154 g of Compound 3 having a melting point of 79° to 88° C. in a yield of 63%.

Elemental Analysis for $C_8H_{18}O_4S_2$:

| | C | H |
|---|---|---|
| Calculated (%): | 39.67 | 7.49 |
| Found (%): | 39.52 | 7.55 |

In the present invention, the organic thioether compounds are added in at least one step for producing the emulsion. The compounds may be added during Agx formation of silver halide grains, physical ripening or chemical ripening, or in a separate step immediately before coating. In particular, addition upon Agx formation physical or chemical ripening is preferable.

In the present invention, silver halide grains can be formed according to a process generally well known in the art, with a double jet process being particularly preferable.

The double jet process is the process of adding a silver nitrate aqueous solution and an aqueous solution of one or more halides (e.g., an alkali metal halide like potassium bromide) simultaneously to a stirred solution of silver halide-protecting colloid (e.g., gelatin or gelatin derivative) through two separate jets. The compound is preferably added to the protective colloid solution before initiation of AgX formation. However, the compound may also be added in the course of the AgX formation through the jet adding the halides and/or the jet for adding the silver nitrate, or through another jet.

Conditions for forming silver halide grains such as pH, pAg, temperature, etc., are not particularly limited in the present invention. However, pH is preferably about 1 to 9, particularly preferably about 2 to 6, and pAg is preferably kept at about 5 to 11, particularly preferably about 7.8 to 10.5. Silver halide grains may be formed at temperatures of about 30° to 90° C., with about 35° C. to 80° C. being particularly preferable. pH, pAg, and temperature may of course be changed during formation of silver halide grains.

The organic thioether compound is preferably added upon formation of silver halide grains and/or physical ripening in an amount of about 0.01 to 100 g, particularly preferably about 0.1 to 10 g, per mol of silver halide.

The thioether compounds of the present invention may be used upon formation of silver halide grains as a solvent for silver halide grains so as to obtain uniform size distribution of the silver halide grains or to increase the size. A suitable amount of the thioether compound for this purpose is about 0.1 to 100 g per mol of silver halide.

In addition to the use of the compounds as a solvent for silver halide grains, the compounds of the present invention provide an emulsion exhibiting high photographic sensitivity and a high contrast with less fog, which is one object of the present invention when added in relatively small amounts scarcely influencing the grain size distribution. A suitable amount of the thioether to be added for this purpose upon Agx formation or physical ripening, is about 0.01 to 1 g per mole of silver halide.

Silver halides used in the present invention are not particularly limited but silver bromoiodide (iodide content: 0.5 to 10 mol%) is particularly preferable. Mean grain size is preferably about 0.2 to 2.5μ.

In addition to the above-described processes, silver halide grains may also be formed by reference to, for example, U.S. Pat. Nos. 2,222,264, 2,592,250, 3,206,313, 3,447,927, 3,501,307, 3,761,276, British Pat. Nos. 723,019, 1,027,146, etc. *The Journal of Photographic Science,* 12, pp. 242–251 (1963), ibid., 13, pp. 85–89 (1965), and ibid., 13, pp. 98–107.

The thus formed emulsion containing silver halide grains is washed with water according to the methods described in U.S. Pat. Nos. 2,618,556, 2,614,928, 2,565,418, 2,489,341, etc., and transferred to the subsequent chemically ripening step. This chemically ripening step is not particularly limited, and descriptions given in the aforesaid patent specifications and U.S. Pat.

Nos. 1,623,499, 2,399,083, 3,297,447, etc., can be referred to. In particular, sensitization methods using noble metals like gold compounds or sulfur compounds are preferably employed.

In the present invention, the organic thioether compounds may also be added in the chemically ripening step in order to obtain an emulsion exhibiting high photographic sensitivity and a high contrast with less fog as has been described before. In this case, the organic thioether compounds are added in an amount of about 0.001 to 1 g, particularly preferably about 0.01 to 0.2 g, per mol of silver halide.

The photographic emulsion of the present invention generally contains the thioether compound in an amount of about 0.001 to 1 g per mol of silver halide.

Conditions for the chemically ripening step such as pH, pAg, temperature, additives, etc., are not particularly limited in the present invention, and the ripening can be conducted under conditions commonly employed in this art. For example, pH value is about 3.0 to 8.5, preferably about 5.0 to 7.5, pAg value is about 7.0 to 9.5, preferably about 8.0 to 9.3, temperature is about 40° to 85° C., preferably about 45° to 75° C., and time is about 10 to 200 minutes, preferably about 30 to 120 minutes.

As the chemically sensitizing agents used in the present invention, there are illustrated, for example, gold (III) chloride, gold (I) sulfide, potassium gold thiocyanate, potassium chloroaurate, ammonium chloropalladate, ruthenium, rhodium, palladium, iridium compound, iminoaminomethanesulfinic acid, diethylenetriamine, thiourea dioxide, allyl isothiocyanate, thiourea, allylthiourea, thioacetamide, allylselenourea, allyltelluriumurea, etc.

To the thus chemically ripened emulsion are added additives, so-called coating finals, then the emulsion is coated on various supports and dried to obtain silver halide photographic light-sensitive materials.

Additives to the emulsion are not particularly limited but as sulfur sensitizing agents there are thiosulfates, thioureas, thiazoles, rhodanines, or like compounds. Specific examples thereof are described in U.S. Pat. Nos. 1,574,944, 2,410,689, 2,278,947, 2,728,668 and 3,656,955. As the reduction sensitizing agents there are stannous salts, amines, hydrazine derivatives, formamidinesulfinic acids, silane compounds, etc. Specific examples thereof are described in U.S. Pat. Nos. 2,487,850, 2,419,974, 2,518,698, 2,983,609, 2,983,610 and 2,694,637. In addition to gold complex salts, complexes of metals of group VIII in the Periodic Table such as platinum, iridium, palladium, etc., can be used. Specific examples thereof are described in U.S. Pat. Nos. 2,399,083, 2,448,060, British Pat. No. 618,061, etc.

Furthermore, for the purpose of increasing sensitivity, contrast, or accelerating development, there may be incorporated, for example, polyalkylene oxide or the ether, ester or amine derivative thereof, thioether compounds, thiomorpholines, quaternary ammonium salts, urethane derivatives, urea derivatives, imidazole derivatives, 3-pyrazolidones, etc. For example, those described in U.S. Pat. Nos. 2,400,532, 2,423,549, 2,716,062, 3,617,280, 3,772,021, 3,808,003, etc., can be used.

In addition, various compounds can be incorporated to prevent fogging in the course of producing light-sensitive materials, or during storage or photographic processing, or for stabilizing photographic properties. That is, there can be added many compounds known as anti-fogging agents or stabilizers, such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds like oxazolinethione; azaindenes (e.g., triazaindenes, tetraazaindenes (in particular, 4-hydroxy substituted (1,3,3a,7)-tetraazaindenes), pentaazaindenes, etc.); benzenesulfinic acid; benzenesulfonic acid amide; etc.

Anti-fogging agents particularly preferred for use in combination with the thioether compounds of the present invention are the compounds represented by the following general formula (A), (B), or (C):

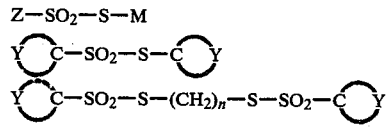

wherein Z represents a straight or branched chain alkyl group containing 1 to 18 carbon atoms, a monocyclic or bicyclic aryl group containing 6 to 18 carbon atoms, or a 5- or 6-membered heterocyclic ring, Y represents an aromatic ring containing 6 to 18 carbon atoms, or the atoms necessary for forming a 5- or 6-membered heterocyclic ring, M represents a monovalent metal ion or a monovalent organic cation, and n represents an integer of 2 to 10.

The alkyl group, aryl group, heterocyclic ring group, aromatic ring, and heterocyclic ring represented by Z or Y in general formula (A), (B), or (C) may be substituted. Examples of the substituents include, for example, a lower alkyl group having 1 to 3 carbon atoms (e.g., methyl, ethyl, etc.), an aryl group (e.g., phenyl, etc.), an alkoxy group containing 1 to 8 carbon atoms, a halogen atom (e.g., chlorine, bromine, etc.), a nitro group, an amino group, a carboxyl group, etc.

As the heterocyclic ring represented by Z or Y, there are illustrated those unsaturated rings containing one or more of nitrogen, oxygen and/or sulfur atom(s) such as thiazole, benzothiazole, imidazole, benzimidazole, oxazole rings, etc.

As the metal ion represented by M, there are illustrated monovalent alkali metal ions such as sodium, potassium, etc., and as the organic cation there are preferably illustrated an ammonium ion, a guanidine group, etc.

Specific examples of the compounds represented by general formula (A), (B), or (C) are illustrated below.

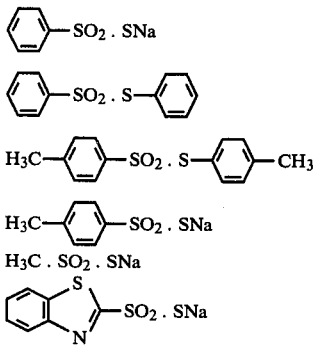

-continued

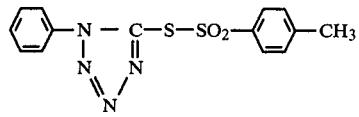

(g)

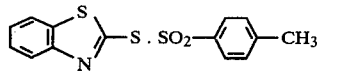

(h)

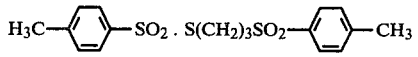

(i)

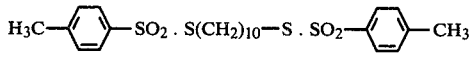

(j)

1-Cystine-disulfoxide (k)

The compounds represented by general formula (A), (B), or (C) can generally be synthesized according to well known processes. For example, they can be synthesized by reacting a corresponding sulfonyl fluoride with sodium sulfide, or by reacting corresponding sodium sulfinate with sulfur.

The compounds represented by general formula (A), (B), or (C) are preferably added in an amount of about 0.001 to 1 g, particularly about 0.01 to 0.2 g, per mol of silver halide. A suitable molar proportion of the thioether of the present invention to the compound represented by general formula (A), (B) or (C) is 1:0.001 to 1:0.1 when the thioether is added upon silver halide formation and/or physical ripening period and 1:0.5 to 1:2 when the thioether is added in chemical ripening step. The addition is conducted upon chemical ripening or immediately before coating.

As the binder or protective colloid for the photographic emulsion of the present invention, gelatin is advantageously used. However, other hydrophilic colloids are also suitable.

For example, proteins such as gelatin derivatives, graft polymer between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivatives, etc.; various synthetic hydrophilic high homopolymers or copolymers such as polyvinyl alcohol, poly-N-vinylpyrrolidone, polyacrylic acid, polymethacrylic acid, polyacrylamide, polyvinylimidazole, polyvinyl pyrazole, etc., can be used.

As gelatin, acid-processed gelatin may be used as well as lime-processed gelatin. Further, gelatin hydrolyzates, and enzyme-hydrolyzed products of gelatin are also usable.

Various known surface active agents may be incorporated in the photographic emulsion layer or other hydrophilic colloid layer formed according to the present invention for the purpose of coating aid, prevention of static charge, improvement in lubricating property, improvement in emulsion dispersion, prevention of adhesion, and improvement in photographic characteristics (for example, acceleration of development, increase in contrast, sensitization, etc.).

For example, there can be used nonionic surface active agents such as saponin (steroid series), alkylene oxide derivatives (e.g., polyethylene glycol, polyethylene glycol/propylene glycol condensate, polyethylene glycol alkyl or alkylaryl ether, polyethylene glycol esters, polyethylene glycol sorbitan esters, polyalkylene glycol alkylamines or amides, polyethylene oxide adducts of silicione, etc.), glycidol derivatives (e.g., alkenylsuccinic acid polyglyceride, alkylphenol polyglyceride, etc.), polyhydric alcohol fatty acid esters, alkyl esters of sugars, urethanes, ethers, etc.; anionic surface active agents containing acidic groups like carboxyl group, sulfo group, phospho group, sulfuric acid ester group, phosphoric ester group, etc., such as triterpenoid saponin, alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkylphenyl ethers, polyoxyethylene alkylphosphoric esters, etc.; amphoteric surface active agents such as amino acids, aminoalkylsulfonic acids, aminoalkylsulfuric acid esters, aminoalkylphosphoric acid esters, alkylbetaines, amineimides, amine oxides, etc.; cationic surface active agents such as alkylamine salts, aliphatic or aromatic quaternary ammonium salts, heterocyclic ring quaternary ammonium salts (e.g., pyridinium or imidazolium salts), aliphatic or heterocyclic ring-containing phosphonium or sulfonium salts, etc.

A photographic light-sensitive material produced by using the emulsion of the present invention can contain, in the photographic emulsion layer or other hydrophilic colloid layer, a dispersion of water-insoluble or slightly water-soluble synthetic polymer for the purpose of improving stability. There can be used, for example, polymers containing, as monomer components, alkyl (meth)acrylate, alkoxyalkyl (meth)acrylate, glycidyl (meth)acrylate, (meth)acrylamide, vinyl esters (e.g., vinyl acetate, etc.), acrylonitrile, olefin, styrene, etc., alone or in combination, or in further combination with acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

The photographic emulsion of the present invention may be spectrally sensitized with methine dyes or the like. Dyes to be used include cyanine dyes, merocyanine dyes, composite cyanine dyes, composite merocyanine dyes, holopolar cyanine dyes, hemicyanine dyes, styryl dyes, and hemioxonol dyes. Particularly useful dyes are those belonging to merocyanine dyes and composite merocyanine dyes. These dyes contain as a basic heterocyclic ring nucleus any nucleus ordinarily used in cyanine dyes. That is, a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; nuclei wherein an alicyclic hydrocarbon ring is fused to the above-described nuclei; and nuclei wherein an aromatic hydrocarbon ring is fused to the above-described nuclei, i.e., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, etc., may be applied. These nuclei may have substituents on cabon atoms.

To the merocyanine dyes or composite merocyanine dyes may be applied, as a nucleus containing a ketomethylene structure, 5- or 6-membered heterocyclic ring nuclei such as a pyrazolin-5-one nucleus, thiohydantoin nucleus, 2-thiooxazolidine-2,4-dione nucleus, thiazolidine-2,4-dione nucleus, rhodanine nucleus, thiobarbituric acid nucleus, etc.

The light-sensitive material obtained by applying the present invention may contain, in the hydrophilic colloid layer, a water-soluble dye as a filter dye or for the purpose of preventing irradiation, and the like. Such dyes include oxonol dyes, hemioxonol dyes, styryl dyes, merocyanine dyes, cyanine dyes, and azo dyes. Of these, oxonol dyes, hemioxonol dyes, and merocyanine dyes are useful.

The photographic emulsion of the present invention may contain color image-forming couplers, i.e., compounds capable of reacting with an oxidation product of aromatic amine (usually primary amine) to form a dye (hereinafter referred to as "couplers"). As such couplers, non-diffusing ones containing a hydrophobic group called a ballast group, are desirable. Either of 4-equivalent and 2-equivalent couplers based on silver ion are usable. In addition, colored couplers showing the effect of color correction, or couplers releasing a development inhibitor upon development (so-called DIR couplers) may be incorporated. The couplers may be those which provide a colorless coupling reaction product.

As yellow color-forming couplers, there can be used known open-chain ketomethylene couplers. Of these, benzoylacetanilide compounds and pivaloylacetanilide compounds are advantageous. As magenta couplers, there can be used pyrazolone compounds, indazolone compounds, cyanoacetyl compounds, etc., with pyrazolone compounds being particularly advantageous. As cyan couplers, phenolic compounds, naphtholic compounds, etc., can be used.

As DIR couplers, there can be used, for example, those described in U.S. Pat. Nos. 3,227,554, 3,617,291, 3,701,783, 3,790,384, 3,632,345, German Patent Applications (OLS) Nos. 2,414,006, 2,454,301, 2,454,329, and British Pat. Nos. 953,454 and 1,513,537.

In addition to the DIR couplers, the light-sensitive material may contain a compound capable of releasing a development inhibitor upon development. There can be used, for example, those described in U.S. Pat. Nos. 3,297,445, 3,379,529 and German Patent Application (OLS) No. 2,417,914.

Two or more of the above-described couplers can be incorporated in the same layer. On the other hand, the same compound can be incorporated in two or more different layers. These couplers are incorporated in the silver halide emulsion layer according to known methods, for example, that described in U.S. Pat. No. 2,322,027.

The light-sensitive material obtained by applying the present invention may contain, as a color fog-preventing agent, a hydroquinone derivative, aminophenol derivative, gallic acid derivative, ascorbic acid derivative, etc.

The light-sensitive material obtained by employing the present invention may contain an ultraviolet ray-absorbing agent in the hydrophilic colloid layer. For example, there can be used aryl-substituted benzotriazole compounds (e.g., those described in U.S. Pat. No. 3,533,794), 4-thiazolidone compounds (e.g., those described in U.S. Pat. Nos. 3,314,794, and 3,352,681), benzophenone compounds (e.g., those described in Japanese Patent Application (OPI) No. 2784/71), cinnamic esters (e.g., those described in U.S. Pat. Nos. 3,705,805 and 3,707,375), or benzoxazole compounds (e.g., those described in U.S. Pat. No. 3,499,762).

The photographic emulsion of the present invention is coated on a support conventionally used for photographic light-sensitive materials such as a flexible support (e.g., plastic film, paper, etc.) or a rigid support (e.g., glass, etc.) according to a dip-coating method, roller coating method, curtain coating method, extrusion coating method, or the like. Useful examples of the flexible support include films comprising semi-synthetic or synthetic high polymers such as cellulose nitrate, cellulose acetate, cellulose acetate butyrate, polystyrene, polyvinyl chloride, polyethylene terephthalate, polycarbonate, etc., papers having coated or laminated thereon a baryta layer or an $\alpha$-olefin polymer layer (for example, polyethylene, polypropylene, ethylene/butene copolymer), and the like.

The present invention can be applied to a multilayer multicolor photographic material comprising a support having provided thereon at least two layers showing two different spectral sensitivities. Multilayer natural color photographic materials usually comprise a support having provided thereon at least one red-sensitive emulsion layer, at least one green-sensitive emulsion layer, and at least one blue-sensitive emulsion layer. The order of these layers can optionally be selected as occasion demands. Usually, a cyan-forming coupler is incorporated in the red-sensitive emulsion layer, a magenta-forming coupler in the green-sensitive emulsion layer, and a yellow-forming coupler in the blue-sensitive emulsion layer. In some cases, however, different combinations may be employed.

In the present invention, exposure for obtaining photographic images may be conducted in a conventional manner. That is, there can be used any of various known light sources such as natural light (sunlight), tungsten lamp, fluorescent lamp, mercury lamp, xenon arc lamp, carbon arc lamp, xenon flash lamp, cathode ray tube flying spot, etc. As to exposure time, not only 1/1,000 to 1 second employed for ordinary cameras but an exposure time shorter than 1/1,000 second, for example, an exposure time of $1/10^4$ to $1/10^6$ second attained by using a xenon flash lamp or a cathode ray tube, and an exposure time longer than 1 second can be employed as well.

One characteristic aspect of the thioether compounds of the present invention is that they increase the photographic sensitivity in a long exposure time (for example, 5 to 10 seconds) as well as in a short exposure time (for example, 1/100 second). Improvement in reciprocity law failure, in particular in low illuminance region (long exposure time), by the compounds of the present invention can be said to be an extremely outstanding aspect of the present invention.

Conventional thioether compounds show a seriously low increase in sensitivity in a low illuminance exposure as compared with that in a high illuminance exposure, and have been extremely disadvantageous from the practical point of view.

The thioether compounds of the present invention have the remarkable characteristics that they increase the sensitivity not only in a high illuminance exposure but in a low illuminance exposure as well and, in addition, the degree of increase in sensitivity for low illuminance is rather higher than that for high illuminance, which results in the sensitivity for the low illuminance becoming the same as the sensitivity for the high illuminance.

The light-sensitive material obtained by applying the present invention can be photographically processed according to any of known processes. Conventional processing solutions can be used. Processing temperatures are usually selected between 18° C. and 50° C. However, temperatures lower than 18° C. or higher than 50° C. may be employed. Either of the black-and-white development processing for forming silver images and the color photographic processing comprising a dye image-forming development processing can be applied as occasion demands.

A developer to be used for the black-and-white photographic processing can contain conventional developing agents. As the developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acids, etc., can be used alone or in combination. In general, the developer further contains a known preservative, alkali agent, pH buffer, anti-fogging agent, etc. In addition, it may contain, if necessary, a dissolving aid, toning agent, development accelerator, surface active agent, defoaming agent, water softener, hardening agent, viscosity-imparting agent, etc.

Fixing solutions having conventional formulations can be used. As the fixing agents, organic sulfur compounds known to show a fixing effect can be used as well as thiosulfates and thiocyanates. The fixing solution may contain a water-soluble aluminum salt as a hardener.

A color developer generally comprises an alkaline aqueous solution containing a color-developing agent. As the color-developing agent, there can be used known primary aromatic amine developing agents, for example, phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.). In addition, those agents described in L.F.A. Mason, *Photographic Processing Chemistry* (Focal Press, 1966), pp. 226–229, U.S. Pat. Nos. 2,193,015, 2,592,364, Japanese Patent Application (OPI) No. 64933/73, etc., may be used.

The color developer can further contain pH buffers (e.g., alkali metal sulfites, carbonates, borates, phosphates, etc.), development restrainers or anti-fogging agents (e.g., bromides, iodides, organic anti-fogging agents, etc.), and the like. In addition, it may contain, if necessary, water softeners, preservatives (e.g., hydroxylamine), organic solvents (e.g., benzyl alcohol, diethylene glycol, etc.), development accelerators (e.g., polyethylene glycol, quaternary ammonium salts, amines, etc.), dye-forming couplers, competitive couplers, fogging agents like sodium borohydride, auxiliary developing agents like 1-phenyl-3-pyrazolidone viscosity-imparting agents, and the like.

After the color development processing, the photographic emulsion layer is usually bleached. This bleaching processing may be conducted simultaneously with the fixing processing, or may be conducted separately. As the bleaching agents, compounds of multivalent metals such as iron (III), cobalt (IV), chromium (IV), copper (II), etc., peracids, quinones, nitroso compounds, etc., can be used. There can be used, for example, ferricyanides, dichromates, organic complex salts of iron (III) or cobalt (III), for example, complex salts of aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.); persulfates, permanganates; nitrosophenols; etc. Of these, potassium ferricyanide, Fe(III) sodium ethylenediaminetetraacetate, and Fe(III) ammonium ethylenediaminetetraacetate are particularly useful. Fe(III) sodium ethylenediaminetetraacetate complex salt is useful both in an independent bleaching solution and in a monobath bleach-fixing solution.

*The Journal of Product Licensing Index,* 92, pp. 107–110 (December 1971) can be referred to for the various additives, processings, etc., described above.

The photographic emulsion of the present invention can be preferably applied to many different silver halide photographic light-sensitive materials due to its high photographic sensitivity, contrast, and less fog.

For example, it is particularly preferably applied to high speed black-and-white negative films, X-ray films for medical use, multilayer color negative films, etc. These light-sensitive materials have recently been developed at elevated temperatures, for example, not lower than 35° C. However, the increase in developing temperature is liable to cause fogging. This tendency is serious particularly in colorforming development. The present invention is particularly preferably applied to such light-sensitive materials to be processed at elevated temperatures.

The reasons the thioether compounds of the present invention remarkably increase photographic sensitivity without fogging as compared with known thioether compounds, in particular, that the degree of increase in the sensitivity for low illuminance is the same as or more than that for high illuminance is not completely clear. However, it may be due to the two or more substituents like —OH, —COOH, etc., in the terminal alkyl group adjacent to sulfur atom.

Thioether compounds wherein the terminal alkyl group adjacent to sulfur atom is substituted by one substituent like —OH have been known. It is surprising and cannot be expected at all that, when the number of the substituents becomes two or more, there result remarkably improved photographic properties. In particular, compounds represented by general formula (II) have a solubility for water as high as 50 g or more per 100 g of water (25° C.) (solubility of compounds having analogous formula to general formula (II) with one substituent being 5 to 10 g per 100 g of water), and hence they can be extremely easily used as additives for silver halide photographic emulsions in addition to their excellent photographic properties.

The present invention will now be described in more detail by the following non-limiting examples.

EXAMPLE 1

To an aqueous solution containing gelatin, potassium iodide, and a slight amount of potassium bromide were simultaneously added an aqueous solution of potassium bromide and an aqueous solution of silver nitrate under vigorous stirring while maintaining the temperature at 70° C. to prepare silver bromoiodide emulsions 1 to 6 containing about 5 mol% AgI and having an average grain size of about 0.7$\mu$.

In this occasion, the thioether compound shown in Table 1 was allowed to exist in the gelatin aqueous solution. The resulting emulsions were cooled, solidified, and washed with cold water to remove unnecessary salts in conventional manner. Then, pH and pAg values were adjusted to predetermined levels, followed by heating to 60° C. Sodium thiosulfate and potassium chloroaurate were added thereto to conduct chemical ripening for 70 minutes.

To the thus obtained emulsions were added, as finals, the following hardener, stabilizer, and coating aid, and the emulsion was coated on a cellulose triacetate film support in an amount of 5.0 g silver/m$^2$, and dried to obtain samples 1 to 6.

Hardener: 2,4-dichloro-6-hydroxy-s-triazine

Stabilizing agent: 4-hydroxy-6-methyl-1,3,3a,7-tetraazaindene

Coating aid: sodium dodecylbenzenesulfonate

The samples 1 to 6 thus obtained were exposed through an optical wedge using a sensitometer (for 1/100 sec.), and developed at 35° C. for 30 seconds using RD-III developer for an automatic developing machine (made by Fuji Photo Film Co., Ltd.). After fixing, washing with water, and drying in a conventional manner, photographic properties (sensitivity and fog) were measured. Thus, there were obtained the results tabulated in Table 1.

TABLE 1

| Sample No. | Thioether Compound | Amount (g) | Photographic Properties Sensitivity | Fog |
|---|---|---|---|---|
| 1 | — | — | 100 | 0.08 |
| 2 | Compound 1 | 1.0 | 140 | 0.11 |
| 3 | Compound 3 | 1.0 | 145 | 0.10 |
| 4 | Compound 8 | 1.0 | 138 | 0.11 |
| 5 | Comparative Compound (A) | 1.0 | 135 | 0.16 |
| 6 | Comparative Compound (B) | 1.0 | 120 | 0.20 |

Comparative compound (A):
$HOCH_2CH_2CH_2-S-CH_2CH_2-S-CH_2CH_2CH_2OH$

Comparative compound (B): $[H_5C_2-NHC(=O)-(CH_2)_3-S-(CH_2)_3]_2O$

Additionally, photographic sensitivities are presented as reciprocals of logarithms of exposure amounts necessary to obtain an optical density of fog+0.20. In Table 1, sensitivity of sample 1 (emulsion 1) was taken as 100, and that of other samples were presented relative to that of sample 1.

Additionally, the amounts of organic thioether compounds shown in Table 1 are per mol of silver halide.

As is clear from Table 1, emulsions (sample Nos. 2 to 4) having been prepared by allowing the thioether compound of the present invention to exist in the gelatin aqueous solution upon formation of silver bromoiodide grains enable to raise sensitivity with scarce increase of fog. On the other hand, where comparative compound (A) or (B) was allowed to exist, there resulted seriously increased fog, and less increased sensitivity as compared with the thioether compounds of the present invention.

This is a surprising effect and believed due to the terminal alkyl groups in Compounds 1, 3 and 8 of the present invention are substituted by two —OH and/or —COOH.

EXAMPLE 2

Emulsions containing silver bromoiodide grains formed in the same manner as in Example 1, sample 1, were cooled, solidified, and washed with cold water to remove unnecessary salts in the same manner as in Example 1.

pH and pAg values of the emulsions having been washed with water were adjusted to predetermined levels, and the emulsions were heated to 61° C., followed by chemical ripening for 60 minutes in the presence of organic thioether compounds as shown in Table 2 to prepare emulsions 11 to 15. Similarly with Example 1, thiourea dioxide and potassium chloroaurate were allowed to exist upon chemical ripening. To the thus obtained emulsions were added the following finals, coated and dried to obtain samples 11 to 15 (dry thickness of the emulsion layer: 6.0μ). Each of the samples was exposed (for 1/100 second) through a yellow filter, development-processed according to processing I described in Japanese Patent Application (OPI) No. 51940/76, Example 1 (using color developer C), followed by measuring photographic properties to obtain the results tabulated in Table 2. The sensitivities given in Table 2 are relative to sample 11 as 100, as in Example 1.

Coupler: 1-(2,4,6-trichlorophenyl)-3-[3-(2,4-di-t-amylphenoxy)acetamido]benzamido-5-pyrazolone (0.75 g/m$^2$)

Spectrally sensitizing agent: bis-{2-[1-ethyl-3-(3-sulfopropyl)-5,6-dichlorobenzimidazole]}trimethinecyanine sodium salt (5.2 mg/m$^2$)

Hardener: 2,4-dichloro-6-hydroxy-1,3,5-triazine sodium salt (14 mg/m$^2$)

Coating aid: sodium p-dodecylbenzenesulfonate (51 mg/m$^2$) sodium p-nonylphenoxypoly(ethyleneoxy)propanesulfonate (60 mg/m$^2$)

TABLE 2

| Sample No. | Thioether Compound | Amount (g) | Photographic Properties Sensitivity | Fog |
|---|---|---|---|---|
| 11 | — | — | 100 | 0.15 |
| 12 | Compound 1 | 0.03 | 125 | 0.17 |
| 13 | Compound 3 | 0.03 | 130 | 0.16 |
| 14 | Compound 8 | 0.03 | 124 | 0.17 |
| 15 | Comparative Compound (A) | 0.03 | 120 | 0.20 |
| 16 | Comparative Compound (B) | 0.03 | 110 | 0.23 |

As is clear from Table 2, photographic sensitivity can be raised with scarce increase of fog by allowing the thioether compounds of the present invention to exist upon chemical ripening.

EXAMPLE 3

Emulsions 21 to 26 were prepared in the same manner as in Example 1 by allowing the thioether compounds shown in Table 3 to exist in a gelatin aqueous solution.

After chemically ripening emulsions 21 to 26 in the same manner as in Example 1, the same finals as in Example 2 were added thereto, coated, and dried to obtain samples 21 to 26. Chemical ripening time was so adjusted that the degree of fog of each sample became about the same level.

Each sample was exposed in two manners: one being conducted with exposure time of 1/100 second; and the other 5 seconds. Of course, light sources were selected to obtain the same exposure amount in the two exposure.

Development was conducted according to the processing described in Japanese Patent Application (OPI) No. 13923/78, Example 1. Developing time was 3 minutes and 15 seconds (38° C.).

Additionally, sensitivities given in Table 3 are relatively presented taking that of sample 21 (with the exposure time of 1/100 second) as 100, as in Example 1.

TABLE 3

| Sample No. | Thioether Compound | Amount (g) | Photographic Properties 1/100 Sec. Exposure Sensitivity | Fog | 5 Sec. Exposure Sensitivity | Fog |
|---|---|---|---|---|---|---|
| 21 | — | — | 100 | 0.17 | 80 | 0.17 |
| 22 | Compound 1 | 1.0 | 137 | 0.19 | 125 | 0.19 |
| 23 | Compound 3 | 1.0 | 140 | 0.19 | 138 | 0.19 |
| 24 | Compound 8 | 1.0 | 138 | 0.20 | 130 | 0.20 |
| 25 | Comparative Compound (A) | 1.0 | 132 | 0.21 | 101 | 0.21 |
| 26 | Comparative Compound (B) | 1.0 | 110 | 0.23 | 89 | 0.23 |

As is clear from Table 3, samples 22, 23, and 24 using the emulsions containing the compounds of the present invention produce a remarkable increase in sensitivity regardless of exposure conditions. In particular, sensitivity was remarkably increased when 5-second exposure was conducted. On the other hand, samples 25 and 26 using comparative compounds showed almost no increase in sensitivity when 5-second exposure was conducted (i.e., long-time exposure with a low illuminance), and are extremely disadvantageous for practical use.

EXAMPLE 4

Emulsions 31 to 37 were prepared in the same manner as in Example 3 by allowing the thioether compounds to exist in a gelatin aqueous solution and allowing the anti-fogging agents shown in Table 4 to exist upon chemical ripening. Finals were added similarly with Example 2, and the resulting mixtures were coated and dried to obtain samples 31 to 38.

After exposing for 5 seconds in the same manner as in Example 3, the samples were developed to obtain the results shown in Table 4.

TABLE 4

| Sample No. | Thioether Compound | Ampount (g) | Anti-Fogging Agent | Amount (g) | Photographic Properties Sensitivity | Fog |
|---|---|---|---|---|---|---|
| 31 | — | — | — | — | 100 | 0.15 |
| 32 | Compound 3 | 1.0 | — | — | 150 | 0.17 |
| 33 | Compound 3 | 1.0 | Compound (a) | 0.003 | 160 | 0.15 |
| 34 | Compound 3 | 1.0 | Sodium Benzenesulfonate | 0.003 | 148 | 0.17 |
| 35 | Compound 6 | 1.0 | — | — | 145 | 0.18 |
| 36 | Compound 6 | 1.0 | Compound (a) | 0.003 | 155 | 0.16 |
| 37 | Comparative Compound (B) | 1.0 | — | — | 110 | 0.23 |
| 38 | Comparative Compound (B) | 1.0 | Compound (a) | 0.003 | 110 | 0.20 |

As is clear from Table 4, existence of the thioether compounds of the present invention upon formation of silver halide serves to remarkably increase sensitivity for low illuminance, without seriously increasing fog. Further, presence of compound (a), an example of anti-fogging agent represented by general formula (A), upon chemical ripening enables to raise sensitivity with scarce or no increase of fog. On the other hand, comparative compound (B) showed almost no such effects.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing about 0.001 to 1 gram per mol of silver halide of the compound represented by the formula:

$$R_5-\underset{\underset{OH}{|}}{CH}-(CH_2)_{n_1}-S-(CH_2)_{n_2}-S-(CH_2)_{n_3}-\underset{\underset{OH}{|}}{CH}-R_5$$

wherein $R_5$ represents an alkyl group containing 1 to 3 carbon atoms substituted by —OH, —COOH, —COOM, or —COOR, the number of substituents being 1 or 2, $n_1$ and $n_3$ each represents 1 or 2, and $n_2$ represents 1, 2, 3, or 4, M represents an alkali metal atom, and R represents a hydrogen atom or an alkyl group containing 1 to 5 carbon atoms.

2. The silver halide emulsion of claim 1 additionally containing about 0.001 to 1 gram per mol of silver halide of a compound represented by the formulae (A), (B) or (C):

$$Z-SO_2-S-M \quad (A)$$

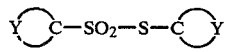
(B)

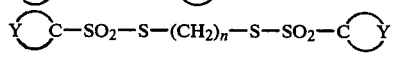
(C)

wherein Z represents an alkyl group containing 1 to 18 carbon atoms, an aryl group containing 6 to 18 carbon atoms, or a heterocyclic ring, Y represents an atomic group necessary to complete an aromatic ring containing 6 to 18 carbon atoms or a heterocyclic ring, M represents a metal atom or an organic cation and n represents an integer of 2 to 10.

3. The silver halide emulsion of claim 1, wherein said thioether compound is present in an amount of about 0.01 g to 0.2 g per mol of silver halide.

4. The silver halide emulsion of claim 2, wherein the molar ratio of said thioether compound to the compound represented by the formulae (A), (B) or (C) is about 1:0.001 to 1:2.

5. The silver halide emulsion of claim 1, wherein said emulsion further contains a sensitizing agent.

6. In a process for preparing a silver halide emulsion, the improvement which comprises adding about 0.001 to 1 gram per mol of silver halide of a compound of the formula:

$$R_5-\underset{\underset{OH}{|}}{CH}-(CH_2)_{n_1}-S-(CH_2)_{n_2}-S-(CH_2)_{n_3}-\underset{\underset{OH}{|}}{CH}-R_5$$

wherein $R_5$ represents an alkyl group containing 1 to 3 carbon atoms substituted by —OH, —COOH, —COOM or —COOR, the number of substituents being 1 or 2, $n_1$ and $n_3$ each represents 1 or 2, and $n_2$ represents 1, 2, 3 or 4, M represents an alkali metal atom, and R represents a hydrogen atom or an alkyl group containing 1 to 5 carbon atoms, during preparation and before said emulsion is coated on a support.

7. The process of claim 6, wherein said thioether compound is added upon silver halide formation and/or physical ripening.

8. The process of claim 6, wherein said thioether compound is added during chemical ripening.

9. The process of claim 6, wherein said thioether compound is added in an amount of about 0.01 g to 0.2 g per mol of silver halide.

10. The process of claim 6, wherein in addition to said thioether compound about 0.001 to 1 gram per mol of silver halide of a compound of the formula (A), (B) or (C) is added to said emulsion:

$$Z-SO_2-S-M \quad (A)$$

-continued

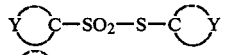

(B)

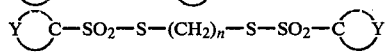

(C)

wherein Z represents an alkyl group containing 1 to 18 carbon atoms, an aryl group containing 6 to 18 carbon atoms, or a heterocyclic ring, Y represents an atomic group necessary to complete an aromatic ring containing 6 to 18 carbon atoms or a heterocyclic ring, M represents a metal atom or an organic cation and n represents an integer of 2 to 10.

11. A silver halide emulsion prepared by the process of claim 6, 7 or 8.

* * * * *